US007807908B1

(12) United States Patent
Adamson

(10) Patent No.: US 7,807,908 B1
(45) Date of Patent: Oct. 5, 2010

(54) METHOD FOR AUTOMATIC REAL-TIME VARIABLE PERFORMANCE INTONATION OF CHROMATIC INSTRUMENTS

(76) Inventor: Hans Carl-Axel Adamson, 3530 Moore St., Los Angeles, CA (US) 90066

( * ) Notice: Subject to any disclaimer, the term of this patent is extended or adjusted under 35 U.S.C. 154(b) by 645 days.

(21) Appl. No.: 11/603,046

(22) Filed: Nov. 22, 2006

(51) Int. Cl.
*G10D 3/14* (2006.01)
*G10D 7/02* (2006.01)

(52) U.S. Cl. ..... 84/312 R; 84/454; 84/609; 84/622

(58) Field of Classification Search ..... 84/312 R, 84/609–614, 619, 634–638, 649–652, 666–669, 84/712–717, 657, 685, 600, 622, 624, 631, 84/708, 701, 673
See application file for complete search history.

(56) References Cited

U.S. PATENT DOCUMENTS 5,220,122 A * 6/1993 Shibukawa ..... 84/669
5,302,777 A * 4/1994 Okuda et al. ..... 84/637
5,442,129 A * 8/1995 Mohrlok et al. ..... 84/637
6,002,080 A * 12/1999 Tanaka ..... 84/615

* cited by examiner

*Primary Examiner*—Elvin G Enad
*Assistant Examiner*—Christopher Uhlir

(57) ABSTRACT

A method for automatic real-time performance intonation (ARPI) of electronic, digital, or computer-based musical instruments automatically adds the intonation characteristics of a variable-intonation instrument performance to an equal-tempered chromatic instrument performance. The method emphasizes the directional lead-in quality, upwards, or downwards, of certain notes in relation to the musical context. Notes, which are musically desirable to resolve upwards in a harmonic progression receive a slightly raised pitch, and notes that generally are resolved downwards receive a slightly lowered pitch. The method identifies major thirds and major sevenths in the harmonic context and raises their pitch slightly. It identifies minor thirds and minor sevenths in the harmonic context and lowers their pitch slightly. Fourth and fifth intervals are given a pure perfect tuning and octaves are made slightly wide. All is done automatically in real-time by identifying the harmonic context from a few preceding notes.

2 Claims, 1 Drawing Sheet

METHOD FOR AUTOMATIC REAL-TIME VARIABLE PERFORMANCE INTONATION OF CHROMATIC INSTRUMENTS

CROSS-REFERENCE TO RELATED APPLICATIONS

The following U.S. Patent Documents are related to the field of the Invention, and are mentioned in the Specification:

U.S. Pat. No. 5,501,130 Gannon

U.S. Pat. No. 5,442,129 Mohrlok, et al.

U.S. Pat. No. 6,924,426 Clynes, et al.

U.S. Pat. No. 5,220,122 A Shibukawa, Takeo

U.S. Pat. No. 5,302,777 Okuda et al.

U.S. Pat. No. 6,002,080 A Tanaka, So

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

The equal tempered tuning of today's chromatic electronic and digital instruments is a compromise that the evolution of Western music has produced to allow chromatic instruments with fixed tuning to play music that progresses through many keys, modulating from one harmony to another. This is done by allowing all notes of the instrument to be very slightly out of tune. This type of tuning of a chromatic instrument is at one end of a spectrum, where at the other end we find the just tuning, where the intervals are based on the harmonics of the root of the key. The just tuning will sound at its best in the key which root it has been tuned after. The further away you modulate in the circle of fifths from this key, the more out of tune the tuning will be. Several fixed tuning systems with characteristics between the just tuning and the equal tempered tuning exist. Gannon U.S. Pat. No. 5,501,130 offers an historical treatment of static tuning systems.

Electronic and digital technology has made it possible to manipulate the fixed tuning of a chromatic equal tempered instrument to allow flexible intonation depending on the melodic and harmonic contents of the music. It has been considered desirable to come closer to a just tuning for the key the music is performed in. Mohrlok U.S. Pat. No. 5,442,129 describes a method of achieving a just tuning by comparing played notes to chord patterns arranged in tables. Clynes U.S. Pat. No. 6,924,426 describes a method of achieving an automatic expressive tuning by pitch adjustment determined by the interval of two consecutively played notes, without regard to the harmonic context. None of these methods offers a way to provide an intonation consistent with the practices developed by orchestral musicians when performing Western music.

Shibukawa U.S. Pat. No. 5,220,122 A describes an "Automatic accompaniment device with chord note adjustment" that can identify chords "to generate accompaniment tones in conformity with the detected tonality." Okuda et al. U.S. Pat. No. 5,302,777 describes a "Music apparatus for determining tonality from chord progression for improved accompaniment" that will determine tonality of music by examining the input chords. Tanaka U.S. Pat. No. 6,002,080 A describes an "Electronic wind instrument capable of diversified performance expression" which provides a "plurality of keys for designating a pitch and a plurality of sensors for detecting operating states of the keys."

BRIEF SUMMARY OF THE INVENTION

The Invention is a method for providing automatic real-time performance intonation (ARPI) to electronic, digital, or computer-based chromatic instruments with equal temperament tuning. It is based on a theory of how intonation practices have developed among orchestral musicians as Western music has evolved.

Western music has through time developed a system of parallel linear voices which when played simultaneously, vertically result in chords and harmonies that modulate as the music moves forward. Tension and release are repeated over and over. Western music theory requires individual notes in the voicing to be resolved according to strict rules: A) The major third of a dominant chord must be resolved a half step upwards to the root of the key when progressing from a dominant chord to a tonic chord. B) The major third of the tonic chord must be resolved upwards to the root of the subdominant chord when progressing from tonic to subdominant. C) The minor seventh of a dominant seventh chord must be resolved downwards to the major third of the tonic chord when progressing from the dominant seventh chord to the tonic.

Orchestral musicians playing variable-intonation instruments, such as the violin, will make a lead-in note extra sharp if it must be resolved upwards. This provides extra directional emphasis and tension before the note is resolved. When a note has to be resolved downwards because of the harmonic context, it is made extra flat to provide direction and tension. This intonation practice gives a result opposite to that of a pure just tuning. In the just tuning, the seventh diatonic note in a major key is tuned flatter than in the equal tempered tuning of a chromatic instrument, and will thus not provide the emphasized directional lead-in note character. Similarly, just tuning will also provide a major third that is tuned flatter than the same third in an chromatic instrument with equal tempered tuning, and no lead-in note directional character will be provided when progressing from the tonic chord to the subdominant.

The basis for the Invention method is the practice outlined above, of making certain notes extra sharp, or extra flat, to provide directional emphasis in a harmonic progression,—not the strive for a pure just tuning as has been the goal in earlier attempts to provide performance intonation to equal tempered Chromatic electronic and digital instruments. The Invention method combines this intonation practice with pure perfect fifths and pure perfect fourths by expanding the fifths with two cents from their chromatically diminished interval, and reducing the fourths with two cents, just as a violinist would adjust his intonation. Octaves are made slightly wide.

The Invention method employs an analysis of a few preceding notes to determine the harmonic context of the note to be pitch-corrected for the intonation. The analysis is performed by identifying the two most characteristic notes for any key in relation to the note played. The simplicity of this process allows real-time execution of the analysis while playing, and an on-the-fly automatic correction of the pitch.

DETAILED DESCRIPTION OF THE INVENTION

Figure 1:
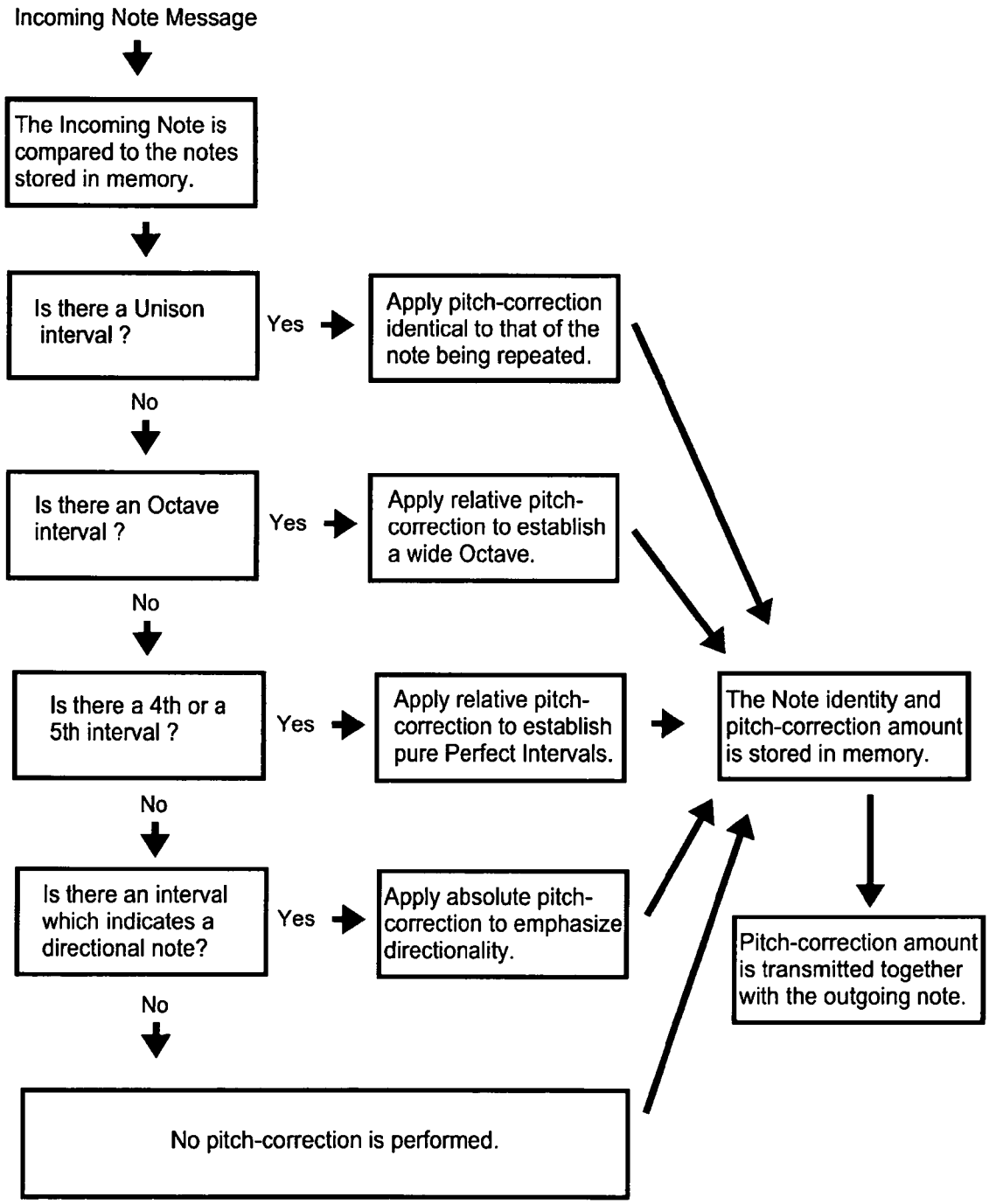
FIG. 1 shows a schematic of the complete method. An incoming Note Message is analyzed as regards to Criteria A-D. Pitch-correction is calculated and the necessary information to perform this pitch-correction is transmitted together with the outgoing note message.

The Invention is a method to apply variable intonation to a chromatic instrument with an equal tempered tuning. Previous attempts to provide such intonation differ from the Invention in that they have either tried to provide a just tuning, or have provided a variable intonation depending on the interval played without consideration of the harmonic context.

The Invention attempts to approximate the real-world slight intonation adjustments a human musician would make when playing a variable intonation instrument. This approximation is made considering four different criteria:

(1) A. Whether the note can be interpreted as having a directional quality in the harmonic context.

(2) B. Whether the note has the interval of a fifth or a fourth from one of the immediately preceding notes.

(3) C. Whether the note has the interval of an octave from one of the immediately preceding notes.

(4) D. Whether the note is a repetition of one of the immediately preceding notes.

The most significant criterion is "A." This is where this method will give pitch-corrections diametrically opposite to those of previous variable intonation systems aiming for just tuning. When a note is determined to be a major third or a major seventh in the harmonic context, it shall receive a slight raise in pitch compared to an equal tempered chromatic tuning. When a note is determined to be a minor third or a minor seventh in the harmonic context, it shall receive a slightly lowered pitch compared to an equal tempered chromatic tuning. The purpose for this is to emphasize the note's directionality from the perspective of chord progressions common in Western music, particularly chord progressions in the circle of fifths.

In variable intonation systems for just intonation, the major thirds and the major sevenths will instead receive a slightly lowered tuning favoring perfect consonance over directional emphasis in the note. Furthermore, those kind of systems will slightly raise the minor thirds and minor sevenths—again to favor perfect consonance over directionality.

The pitch corrections under criterion "A" are all to be made in relation to the fixed chromatic equal tempered tuning of the note to be corrected.

Criterion "B" looks to whether there is the interval of a fifth relative to any of the immediately preceding notes. The analyzed note shall receive a 2 cents raise in pitch if it occurs a fifth above the compared preceding note. If the analyzed note occurs a fifth below the compared preceding note, the pitch shall be lowered by 2 cents.

Similarly, criterion "B" looks to whether there is the interval of a fourth relative to any of the preceding notes. Such an interval shall result in a 2 cents lowering of the pitch, if the preceding note in the interval is lower than the analyzed note. If the analyzed note is lower than the preceding note in the interval, it shall receive a 2 cents raise in pitch.

The pitch corrections under criterion "B" are made in relation to the current tuning of a preceding note to which there is a fifth's or a fourth's interval. For instance, if a preceding note a fifth below already has a pitch-correction of +2 cents, the resulting pitch-correction of the analyzed note shall be +4 cents. The implementation of pitch-correction for notes under criterion "B" ensures a pure tuning of perfect fifth intervals and perfect fourth intervals.

Criterion "C" looks to whether there is the interval of an octave relative to any of the immediately preceding notes. If the analyzed note is an octave higher, it shall receive a slightly raised pitch relative to the lower note of this interval. If the analyzed note is an octave lower relative to the preceding note in the interval, it shall receive a slightly lowered pitch. Just as in the case of pitch-corrections under criterion "B," the pitch corrections under criterion "C" shall be made relative to tuning of the preceding note of the interval. Any amount of pitch correction applied to the earlier note in the interval shall be added to the pitch-correction of the analyzed note.

The pitch-correction implementation under criterion "C" is based on a theory of the inherent imperfection of the harmonics in a physical instrument, suggesting that the second harmonic (octave) of a note often is slightly wide.

Criterion "D" looks to whether the note is a repetition of any of the immediately preceding notes. If so, the analyzed note shall receive the same amount of pitch correction as the note which it is a repetition of. This prevents drift of the pitch and ensures pitch consistency in trills.

The Invention provides a technique for real-time analysis and execution of the variable intonation pitch-corrections under criteria A-D. By storing a small number of the immediately preceding notes in a memory, a note may be analyzed regarding how it fits into the preceding harmonic context and pitch-corrected in real-time as follows:

If among the preceding notes stored in memory there occurs a note four (4), or, six (6), but not five (5) semitone steps below the analyzed note, or, if a preceding note in memory, which if it were to be transposed any number of octaves up or down, could occur four (4), or, six (6), but not five (5) semitone steps below the analyzed note, the analyzed note shall, for the purpose of detecting and emphasizing a supposed inherent direction for its resolution in a harmonic progression, be given the assignment of a major seventh in the harmonic context, falling under criterion "A" above, and shall be given a slightly raised pitch.

Example 1

The note D# is analyzed, and the note A (six semitone steps below) is found preceding it. No other major scale than E-major includes both the notes D# and A, but not the note A# (five semitone steps below). In the E major key, the notes E and D# form a major seventh, and D# is the major seventh of the key's Imaj7 chord. As shown, the algorithm of claim 2 will here assign the note D# the status of a major seventh, unless it is also preceded by the note A# (five semitone steps below), in which case the algorithm will not assign D# the status of a major seventh.

Example 2

The note D# is analyzed, and the note B (four semitone steps below) is found preceding it. No other major scale than E-major includes both the notes D# and B, but not the note A# (five semitone steps below). In the E major key, the notes E and D# form a major seventh, and D# is the major seventh of the key's Imaj7 chord. As shown, the algorithm of claim 2 will here assign the note D# the status of a major seventh, unless it is also preceded by the note A# (five semitone steps below), in which case the algorithm will not assign D# the status of a major seventh.

If among the preceding notes stored in memory there occurs a note three (3), or five (5) but not four (4) semitone steps below the analyzed note, or, if a preceding note in memory, which if it were to be transposed any number of octaves up or down, could occur three (3), or five (5) but not four (4) semitone steps below the analyzed note, the analyzed note shall, for the purpose of detecting and emphasizing a supposed inherent direction for its resolution in a harmonic progression, be given the assignment of a minor third or a minor seventh in the harmonic context, falling under criterion "A" above, and shall be given a slightly lowered pitch.

Example 3

The note Bb is analyzed, and the note F (five semitone steps below) is found preceding it. Only four major scales include both the notes Bb and F, but not the note F# (four semitone steps below): Ab major, Eb major, F major, Bb major. In all of these keys the notes C and Bb form a minor seventh, and the notes G and Bb form a minor third: In the Ab major key, Bb is the minor seventh of the iii7 chord and the minor third of the vii(b5) chord. In the Eb major key, Bb is the minor seventh of the vi7 chord and the minor third of the iii chord. In the F major key, Bb is the minor seventh of the V7 chord and the minor third of the ii chord. In the Bb major key, Bb is the minor seventh of the ii7 chord and the minor third of the vi chord. As shown, the algorithm of claim 2 will here assign the note Bb the status of a minor seventh or a minor third, unless it is also preceded by the note F# (four semitone steps below), in which case the algorithm will not assign Bb the status of a minor seventh or a minor third. It should be noted that the assignment as a minor seventh or a minor third will render one single possible intonation correction by the algorithm, lowering the pitch of Bb slightly.

Example 4

The note Bb is analyzed, and the note G (three semitones below) is found preceding it. Only four major scales include both the notes Bb and G, but not the note F# (four semitone steps below): Ab major, Eb major, F major, Bb major. In all of these keys the notes C and Bb form a minor seventh, and the notes G and Bb form a minor third: In the Ab major key, Bb is the minor seventh of the iii7 chord and the minor third of the vii(b5) chord. In the Eb major key, Bb is the minor seventh of the vi7 chord and the minor third of the iii chord. In the F major key, Bb is the minor seventh of the V7 chord and the minor third of the ii chord. In the Bb major key, Bb is the minor seventh of the ii7 chord and the minor third of the vi chord. As shown, the algorithm of claim 2 will here assign the note Bb the status of a minor seventh or a minor third, unless it is also preceded by the note F# (four semitone steps below), in which case the algorithm will not assign Bb the status of a minor seventh or a minor third. It should be noted that the assignment as a minor seventh or a minor third will render one single possible intonation correction by the algorithm, lowering the pitch of Bb slightly.

If among the preceding notes stored in memory there occur two notes, four (4) and five (5) semitone steps below the analyzed note, or, if two preceding notes in memory, which if they were to be transposed any number of octaves up or down, could occur four (4) and five (5) semitone steps below the analyzed note, the analyzed note shall, for the purpose of detecting and emphasizing a supposed inherent direction for its resolution in a harmonic progression, be given the assignment of a major third in the harmonic context, falling under criterion "A" above, and shall be given a slightly raised pitch.

Example 5

The note Bb is analyzed, and the notes F (five semitone steps below) and Gb (four semitone steps below) are found preceding it. Only two major scales include both the note Bb and the notes Gb and F (four and five semitone steps below): Gb major, Db major. In both of these keys the notes Gb and Bb form a major third. In the Gb major key, Bb is the major third of the I chord. In the Db major key, Bb is the major third of the IV chord. As shown, the algorithm of claim 2 will here assign the note Bb the status of a major third, and the pitch of the Bb will be slightly raised.

If among the preceding notes stored in memory there occurs a note seven (7) semitone steps below or seven (7) semitone steps above the analyzed note, the analyzed note shall be determined to be a perfect fifth under criterion "B" above and shall be given the pitch-correction necessary to achieve the intonation of a pure perfect fifth as described above.

If among the preceding notes stored in memory there occurs a note five (5) semitone steps below or five (5) semitone steps above the analyzed note, the analyzed note shall be determined to be a perfect fourth under criterion "B" above and shall be given the pitch-correction necessary to achieve the intonation of a pure perfect fourth as described above.

If among the preceding notes stored in memory there occurs a note twelve (12) semitone steps below or twelve (12) semitone steps above the analyzed note, the analyzed note shall be determined to be a perfect octave under criterion "C" above and shall be given the pitch-correction necessary to achieve the intonation of a slightly wide octave as described above.

If among the preceding notes stored in memory there occurs the same note as the analyzed note, the analyzed note shall be determined to be a repetition, and it shall be given a pitch identical to that of the previous occurrence of the note.

The priority order of the four criteria (A-D) will affect the pitch-correction for the variable intonation. The suggested priority order is:

(1) 1. Criterion "D"
(2) 2. Criterion "C"
(3) 3. Criterion "B"
(4) 4. Criterion "A"

Other priority orders are possible, although criterion "D" should always have the highest priority.

What is claimed is:

1. A method for electronic analysis and pitch correction of a note of equal tempered tuning comprising comparing the note to a record of a small number of preceding notes in memory, where among the preceding notes there occurs a note four or six, but not five semitone steps below the analyzed note, or where a preceding note in memory transposed any number of octaves up or down, occurs a note four or six, but not five semitone steps below the analyzed note, the analyzed note, for the purpose of detecting and emphasizing a supposed inherent direction for its resolution in a harmonic progression is given an assignment of a major seventh in a harmonic context, and given a slightly raised pitch, or where among the preceding notes occurs a note three or five, but not four semitone steps below the analyzed note, or where a preceding note in memory transposed any number of octaves up or down, occurs a note three or five, but note four semitone steps below the analyzed note, the analyzed note, for the purpose of detecting and emphasizing a supposed inherent direction for its resolution in a harmonic progression is given an assignment of a minor third or a minor seventh in a harmonic context, and given a slightly lowered pitch, or where among the preceding notes occur two notes, four and five semitone steps below the analyzed note, or two preceding notes in memory, transposed any number of octaves up or down, occurs a note four and five semitone steps below the analyzed note, the analyzed note, for the purpose of detecting and emphasizing a supposed inherent direction for its resolution in a harmonic progression is given an assignment of a major third in the harmonic context and given a slightly raised pitch, wherein Analysis of a note to be pitch-corrected by comparing it to the record of a small number of preceding notes and their tunings, where among these preceding notes there occurs a note twelve (12) semitone steps below the analyzed note, the analyzed note is determined to be a perfect octave and given a slightly raised pitch relative to the pitch of the preceding note twelve (12) semitone steps below, or where among these preceding notes there occurs a note twelve (12) semitone steps above the analyzed note, the analyzed note is determined to be a perfect octave and given a slightly lowered pitch relative to the pitch of the preceding note twelve (12) semitone steps above.

2. The method of claim 1, further comprising:

Real-time execution.

* * * * *